United States Patent [19]

Vanderpool et al.

[11] 4,283,257

[45] Aug. 11, 1981

[54] PROCESS FOR PREPARING AMMONIUM METATUNGSTATE

[75] Inventors: Clarence D. Vanderpool; Martin B. MacInnis, both of Towanda, Pa.

[73] Assignee: GTE Products Corporation, Stamford, Conn.

[21] Appl. No.: 157,571

[22] Filed: Jun. 9, 1980

[51] Int. Cl.[3] ..... C25B 1/00

[52] U.S. Cl. ..... 204/86; 423/53

[58] Field of Search ..... 204/86; 423/53

[56] References Cited

U.S. PATENT DOCUMENTS 3,936,362 2/1976 Vanderpool et al. ..... 204/86

FOREIGN PATENT DOCUMENTS 1119843 7/1968 United Kingdom ..... 204/86

*Primary Examiner*—G. L. Kaplan

*Attorney, Agent, or Firm*—Robert E. Walter

[57] ABSTRACT

In a process for producing ammonium metatungstate from ammonium paratungstate, ammonium paratungstate is introduced in the anode chamber of an electrolytic cell which is separated from the cathode chamber by an inert liquid permeable media, when a direct electric current is passed through the cell, ammonium ions migrate to the cathode compartment resulting in an increased concentration of metatungstate in the anode chamber.

9 Claims, No Drawings

PROCESS FOR PREPARING AMMONIUM METATUNGSTATE

BACKGROUND OF THE INVENTION

This invention relates to an electrolytic process for the preparation of ammonia metatungstate from ammonium paratungstate.

A characteristic feature of the tungstates is the formation of condensed complex anions of isopolytungstates in acid solution. Isopolytungstates formed by the addition of hydrated acid ($H_3O+$) to the tungstate anion ($WO_4--$), have various ratios of the hydrated acid group to the tungstate anion. As the ratio of the hydrated acid groups to tungstate ion increases, the molecular weight increases and the pH is lowered. Paratungstates, metatungstates, and tungstic acid are formed at increasingly higher ratios.

These isopolytungstate compounds are widely used in a catalyst industry, usually as the ammonium salts, since the alkali metal and other salts would normally act as contaminates of the catalyst material.

Ammonium metatungstate may be prepared by a variety of techniques. According to one method, hydrated tungsten trioxide may be dissolved in ammonium tungstate solution until a pH of about 2.5 to 4.0 is reached. This technique requires the addition of large amounts of hydrated tungsten trioxide which becomes less soluble in solution with lower pH values. Filtering the excess may be difficult due to the tendency of the hydrated tungsten trioxide to form a colloid. Yields according to this method approximate 50 percent.

Another technique for the production of ammonium metatungstate is by addition of an ion exchange resin to ammonium tungstate solution or a slurry of ammonium paratungstate crystals until the required pH for formation of the ammonium metatungstate is achieved. The use of ion exchange resins requires regeneration of these materials by the use of a strong mineral acid and a consequent formation of unwanted salt by-products.

Another technique is described in U.S. Pat. No. 3,936,362 to Vanderpool et al. A tungsten compound may be produced by applying an electrical potential across an ion exchange membrane. The type of membrane utilized has anion exchange groups distributed throughout a polymeric matrix. Membranes which may be desirably used in this process are often fragile and not suitable for production of commercial quantities. Due to breakage or plugging of the membrane, it is necessary to replace or clean the membranes resulting in disruption of a commercial process.

SUMMARY OF THE INVENTION

It is an object of the present invention to provide for a simple and inexpensive method for producing ammonium metatungstate from ammonium paratungstate in good yield and relatively pure form by a process capable of withstanding the rigors of commerical manufacturing.

Other and further objects of the present invention will become apparent from a reading to the description of the present invention as hereinafter set forth.

In accordance with the present invention, there is provided a process for preparing ammonium metatungstate from ammonium paratungstate comprising introducing ammonium paratungstate into an anode chamber of an electrolytic cell having an anode in an anode chamber and a cathode in a cathode chamber, said cell containing an aqueous electrolyte and including an inert liquid permeable media separating the anode chamber from the cathode chamber, passing a direct electric current through said cell for transporting ammonium ions from the anode chamber through the liquid permeable media to increase concentration of ammonium metatungstate in the electrolyte within the anode chamber, and withdrawing ammonium metatungstate from the anode chamber.

According to another aspect of the present invention, the liquid permeable media comprises a hard, dense material capable of withstanding the rigors of commercial manufacture and having a plurality of pores suitably sized for the passage of ammonia ion therethrough while hindering the passage of the tungstate ion.

DETAILED DESCRIPTION OF THE INVENTION

The electrolytic cell utilized in the process of the present invention is of the type having an anode chamber and a cathode chamber, each respectively equipped with an anode electrode and cathode electrode formed from an inert material. Both electrodes should be relatively nonreactive or inert with regard to the electrolyte. Suitable electrode materials include graphite or a noble medal such as gold and platinum. The anode and cathode are appropriately connected to a conventional source of direct current so that an electrical potential difference may be applied between the electrodes with the anode being positive and the cathode being nagative. The cathode and anodes are initially immersed in electrolyte consisting essentially of water.

In accordance with the principles of the present invention, the anode chamber or compartment is separated from the cathode chamber or compartment by a liquid permeable media. The media preferably has pores sized to permit the passage of the ammonium ion therethrough and hinder the passage of the tungstate ion therethrough. The liquid permeable media is preferably formed from a hard corrosion resistant ceramic material which is chemically inert. The chemical inertness of the liquid permeable media is characterized by the absence of ion exhange groups or other material which may effect the passage of ions by forming a dynamic membrane which may act to reject ions. It is theorized that the mechanism by which invention operates is based on size and the smaller ammonium ion migrates through the liquid permeable media while the migration of the larger tungsten ion is hindered. The preferred liquid permeable media comprises an inorganic ceramic material such as formed from an inorganic silica glass or aluminum oxide ceramic. Such structures have a rigid structure that results from long term dimensionable stability under pressure while maintaining substantially uniform rejection values. Typical liquid permeable media has pores with diameters from about 1 to 3 microns.

The thickness of the liquid permeable media is not particularly critical. Generally, thicker liquid permeable media requires the cell to be operated at a higher electrical potential. Typical porus ceramic filter media has a thickness on the order of ¼ of an inch.

Ammonium paratungstate is introduced into the anode chamber of the electrolytic cell in any convenient form at the start or during the electrolysis. The ammonia paratungstate may be introduced as a solution, solids generally in form of crystal or as a slurry containing ammonia paratungstate solutions and solids. When ammonia paratungstate is present as solids in a mixture in the anode compartment, it is desirable to agitate the mixture to prevent a cake from forming on the liquid permeable media. Such a cake may block the pores and hinder the passage of ammonia ions therethrough. Any conventional agitator such as a conventional mechanical blade propeller may be used for mixing. The solid particles of ammonia paratungstate contained in the slurry are suspended in the solution by the action of the agitator. Generally about 2.5 to about 5.0 parts of ammonia paratungstate per 20 parts of aqueous electrolyte solution present in the anode compartment may be added. The concentration should be sufficient to provide at least the stoichiometric amount for formation of a desired amount of metatungstate. The amount of ammonium paratungstate added is not particularly critical provided the electrolytic is agitated sufficiently so as not to clog the pores of the liquid permeable media.

A direct current is passed through the electrolytic cell for transporting the ammonium ions from the anode chamber through the liquid permeable medium and into the cathode chamber to form metatungstate of a progressively increasing concentration as the process is continued. The electrical potential required depends on the concentration of the electrolyte, the thickness of the liquid permeable membrane and the cell geometry in general. However, suitable operating potentials generally range from about 5 to about 80 volts. The initial pH of the ammonium paratungstate slurry in the anode compartment is from about 8 to about 6. With continued passage of the current, insoluble ammonium paratungstate will dissolve and act as a source of tungsten anions for the formation of ammonium metatungstate. When a pH from about 4 to about 2 is reached, the passage of current may be halted and ammonium metatungstate collected. The most preferred pH for the formation of metatungstate is from about 4 to about 3. As the anode compartment is depleted of the ammonium ion, the concentration of the ammonium ion in the cathode compartment increases and the pH of the electrolyte present in the cathode department increases with the production of ammonium hydroxides from a pH of about 6 to about 9.0.

After the desired concentration of ammonium metatungstate is reached in the anode compartment, the reaction may be stopped and the electrolyte present withdrawn. It is generally preferable to filter the resulting electrolyte containing ammonium metatungstate so as to remove any insoluble ammonium paratungstate which may be present. The resulting filtrate containing ammonium metatungstate may be evaporated to yield crystals of ammonium metatungstate. By using the process of the present, yields on the order of 97 percent are easily obtainable.

The following examples are intended to illustrate the invention and are not intended to be limited thereof.

EXAMPLE I

An electrolytic cell containing an anode compartment and cathode compartment was made by placing an aluminum oxide ceramic cup, Norton, type P-3-C, which was about four inches in diameter by twelve inches high in a large 4,000 milliliter beaker. The ceramic cup had walls of about ¼ of an inch thick with pores having diameters of from about 1.5 to about 2.2 microns. The electrolyte comprised hot deionized water. Two platinum electrodes connected to a direct current source were appropriately placed with one inside the cylindrical ceramic cup to form the anode compartment and the other within the beaker adjacent the ceramic cup to form the cathode compartment. The ceramic cup was equipped with a mechanical stirer. About 100 grams of ammonium paratungstate crystals were introduced into the ceramic cup and a slurry was formed. After about 105 minutes, 100 more grams of ammonium paratungstate was added in the anode compartment. At about 290 minutes 50 grams of ammonium paratungstate and 100 grams of water were added to the anode compartment. The time temperature, amperage, volts, and pH in the anode and cathode compartment were monitered according to the Table 1.

TABLE 1

| TOTAL TIME (MIN.) | AMPS. | VOLTS | pH in Anode Comp. | pH in Cathode Comp. |
|---|---|---|---|---|
| 0 | 0 | 16.5 | 6.4 | — |
| 25 | .5 | 15.5 | 5.8 | — |
| 35 | .9 | 15.0 | 5.5 | 6.0 |
| 45 | .9 | 15.0 | 5.3 | — |
| 62 | 1.0 | 15.0 | 5.6 | 8.0 |
| 105 | .9 | 15.0 | 5.8 | 8.0 |
| 130 | .9 | 15.0 | 5.8 | 9.0 |
| 153 | 1.1 | 14.5 | 5.6 | 9.0 |
| 245 | 1.2 | 14.4 | 5.2 | 9.0 |
| 277 | 1.5 | 14.0 | 4.6 | >9 |
| 420 | 4.2 | 11.8 | 2.9 | >9 |
| 455 | 5.0 | 11.5 | 2.1 | >9 |

The electrolyte resulting in the anode compartment after the current was halted was filtered and about 1.3 grams of insolubles were removed. Since the most desirable pH for the formation of ammonium metatungstate was passed, some ammonium hydroxide was added to the solution to increase the pH to about 3.2. After evaporation of the water, there remained about 261.8 grams of material which was identified as ammonium metatungstate hydrates by x-ray diffraction. A yield of about 97.2 percent ammonium metatungstate based on tungstate ion was obtained.

EXAMPLE 2

The electrolytic cell as described in Example 1 was utilized and about 454 grams ammonium paratungstate was initially placed in the ceramic cup. The ceramic cup with its contents were placed in the beaker so as to form the anode compartment. The electric current was applied as set forth in Experiment 1 until a pH of about 2 in the anode compartment was reached. About 97.6 grams of undissolved ammonium paratungstate was filtered from the electrolyte in the anode compartment. The pH of the resulting ammonium metatungstate solution was about 3.4. The undissolved ammonium paratungstate was returned to the ceramic cup and the cell was rerun with an electric current to form another batch of ammonium metatungstate.

While there has been shown and described what are presently considered the preferred embodiments of the invention, it would be obvious to those skilled in the art that various changes and modifications may be made therein without departing from the scope of the invention as defined by the apended claims.

We claim:

1. A process for producing ammonium metatungstate from ammonium paratungstate comprising: introducing ammonium paratungstate into an anode chamber of an electrolytic cell having an anode in an anode chamber and a cathode in a cathode chamber, said cell containing an aqueous electrolyte and including an inert liquid permeable media separating the anode chamber from the cathode chamber, passing a direct electric current through said cell for transporting ammonium ions from the anode chamber through the liquid permeable media to increase the concentration of ammonium metatungstate in the electrolyte within the anode chamber, and withdrawing ammonium metatungstate from the anode chamber.

2. A process according to claim 1 wherein said inert liquid permeable media has pores with diameters of from about 1 to about 3 microns.

3. A process according to claim 2 wherein said inert liquid permeable comprises a ceramic material.

4. A process according to claim 1 wherein said ammonium paratungstate is introduced in an amount greater than the solubility limit of ammonium paratungstate in the electrolyte present in the anode chamber.

5. A process according to claim 4 wherein said electrolyte present in the anode chamber is agitated to maintain said ammonium paratungstate in suspension.

6. A process according to claim 1 wherein said direct electric current is passed through said cell until a pH of from about 5 to about 2 is obtained in said anode chamber.

7. A process according to claim 6 wherein said direct current is passed until a pH of from about 4 to about 3 is obtained.

8. A process according to claim 1 wherein the aqueous electrolyte comprising ammonium metatungstate is withdrawn from the anode chamber and ammonium metatungstate is separated.

9. A process according to claim 8 wherein ammonium metatungstate is separated from the aqueous electrolyte by evaporating water from the aqueous electrolyte to leave an ammonium metatungstate residue.

* * * * *